US010542821B2

(12) United States Patent
Breibart

(10) Patent No.: US 10,542,821 B2
(45) Date of Patent: Jan. 28, 2020

(54) DEVICE TO RESTORE PELVIC INTEGRITY AND TO STRENGTHEN THE PELVIC FLOOR AND ANTEVERT THE PELVIC REGION IN SEATED POSTURE AND PREVENT CROSSED LEGS

(71) Applicant: Joan Breibart, New York, NY (US)

(72) Inventor: Joan Breibart, New York, NY (US)

( * ) Notice: Subject to any disclaimer, the term of this patent is extended or adjusted under 35 U.S.C. 154(b) by 0 days.

(21) Appl. No.: 16/045,336

(22) Filed: Jul. 25, 2018

(65) Prior Publication Data

US 2019/0038031 A1 Feb. 7, 2019

Related U.S. Application Data

(60) Provisional application No. 62/540,883, filed on Aug. 3, 2017.

(51) Int. Cl.

| | |
|---|---|
| ***A47C 7/02*** | (2006.01) |
| ***A47C 7/18*** | (2006.01) |
| *A63B 23/20* | (2006.01) |

(52) U.S. Cl.

CPC ..... *A47C 7/021* (2013.01); *A47C 7/029* (2018.08); *A47C 7/18* (2013.01); *A61H 2201/1633* (2013.01); *A63B 23/20* (2013.01)

(58) Field of Classification Search

CPC ..... A47C 7/021; A47C 7/029; A47C 7/18; A47C 16/00; A47C 16/02; A61G 5/1045; A61H 2201/0149; A61H 2201/1633

USPC ..... D6/716.1, 596, 601; 5/653

See application file for complete search history.

(56) References Cited

U.S. PATENT DOCUMENTS

| | | | | | |
|---|---|---|---|---|---|
| 2,769,185 | A * | 11/1956 | Biederman | A47C 7/029 | 5/653 |
| 3,890,004 | A * | 6/1975 | Rail | A47C 3/16 | 297/423.1 |
| 5,996,583 | A * | 12/1999 | King | A61G 7/07 | 128/845 |
| D460,299 | S * | 7/2002 | Lundsgaard | D6/716.1 | |
| D642,846 | S * | 8/2011 | Parish | D6/601 | |
| 2004/0055090 | A1* | 3/2004 | Liao | A47C 7/029 | 5/653 |
| 2013/0198961 | A1* | 8/2013 | Davis | A47C 7/62 | 5/648 |

FOREIGN PATENT DOCUMENTS

| | | | | |
|---|---|---|---|---|
| WO | WO-2012036188 A1 * | 3/2012 | ..... | A47C 7/021 |

* cited by examiner

*Primary Examiner* — Nicholas F Polito

(74) *Attorney, Agent, or Firm* — R. Neil Sudol; Henry D. Coleman

(57) ABSTRACT

A seat cushion for improvement of sitting posture and relief from back and leg pain has a seat portion tapering down from a back end toward a narrow front or forward end. The front end is provided with a vertical projection in the nature of a pommel. The pommel or post is sufficiently large to prevent a user from comfortably crossing his or her legs.

10 Claims, 2 Drawing Sheets

DEVICE TO RESTORE PELVIC INTEGRITY AND TO STRENGTHEN THE PELVIC FLOOR AND ANTEVERT THE PELVIC REGION IN SEATED POSTURE AND PREVENT CROSSED LEGS

BACKGROUND OF THE INVENTION

This invention relates to a device for use when sitting in order to improve one's seated posture. This invention also relates to an associated exercise method utilizing the device.

Many problems associated with back and hip pain arise from the common posture of sitting with one leg crossed over the other. In this posture, the sitter's pelvis is askew, disposed in a posterior tilt. On the side of the lower leg, the front of the hips compresses the femoral nerve, artery and veins bilaterally reducing or interfering with circulation to the lower extremities. On the side of the upper leg, a lateral bending compresses the lumbar spine and nerves. Stress is placed on the hip at that side, including the sciatic nerve and the piriformis muscle. In addition, the femur is adducted. Pain sometimes appear in the foot of the upper leg. Thus, sitting with crossed legs can lead to back pain, hip pain, and/or sciatica.

OBJECTS OF THE INVENTION

An object of the present invention is to provide a device for use by an individual to improve seated posture. The device is used, for instance, while working at a computer where the torso is typically leaning forward to view the screen and type.

A further object of the present invention is to provide such a device which during use thereof makes it at least practically impossible to cross the legs.

Yet another object of the present invention is to provide such a device and an associated method of sitting that facilitates anteversion of the pelvis. These and other objects of the present invention will be apparent to one skilled in the art from the drawings and descriptions herein. Although every feature of the invention is attained in at least one embodiment of the invention, there is not necessarily any one embodiment that achieves all of the objects of the invention.

SUMMARY OF THE INVENTION

A device for facilitating better seated posture comprises one elongate platform with a front "pommel" type design that is similar to what is used in a horse riding saddle.

A seat cushion or sitting-posture improvement device in accordance with the present invention comprises a body of resiliently compressible material, the body having a first end and a second end, where the first end has a first width and a first height and the second end has a second width and a second height, the first width being substantially smaller than the second width. Preferably, but not necessarily, the first height (front end) is greater than the second height (rear end). The second width is sufficiently large so that a rear end portion of the body including the second end is engageable with a user's buttocks (and particularly with the sit bones thereof), while the first width is sufficiently small so that a front end portion of the body including the first end is insertable between a user's thighs adjacent the user's pelvis. The first width and the first height are sufficiently large to prevent the user from comfortably crossing the user's legs when the user is sitting on the rear end portion with the front end portion inserted between the user's thighs adjacent the user's pelvis.

A preferred feature of the invention is the tapered configuration of the rear end portion of the body that permits the user to adjust the position of the seat cushion or sitting device relative to the user's buttocks so that the ischial tuberosities or sit bones are disposed on or in contact with the rear end portion while peripheral regions or outer sides of the user's buttocks, outwardly lateral of the ischial tuberosities or sit bones, are less compressed inasmuch as they likely rest on an underlying seat surface rather than on the seat cushion or sitting device of the invention, with most of the user's sitting weight being transferred to the underlying horizontal support or seat surface via the sitting device.

More particularly, the rear end portion of the seat cushion or sitting-posture improvement device has two opposed upper edges extending from the second end towards the front end portion and oriented at an acute angle to one another. Concomitantly, the rear end portion having a width dimension extending between the two opposed upper edges that decreases in a direction from the second end to the front end portion. This tapered design enables users who have different distances between their ischial tuberosities or sit bones to position their buttocks on the device near the edges of the rear end portion, while allowing the outer or lateral portions of the buttocks to rest relatively uncompressed on the underlying support surface. Most of the user's weight is transferred from the ischial tuberosities or sit bones through the cushion or device of the invention to an underlying chair seat.

Pursuant to further features of the present invention, the front end portion of the seat cushion or sitting-posture improvement device is contiguous, and continuous or integral, with the rear end portion on one side and terminates at the first end on an opposite side, while the front end portion has a lower or bottom surface that is rectangular on three sides. Also, the rear end portion is contiguous, and continuous or integral, with the front end portion on one side and terminates at the second end on an opposite side, the rear end portion having a lower or bottom surface that has a truncated triangular shape.

Where the front end portion has a first upper surface and the rear end portion has a second upper surface, the first upper surface preferably slopes downwardly from a point proximate the first end towards the rear end portion, while the second upper surface slopes downwardly from the second end towards the front end portion. The two upper surfaces join to one another via a smoothly continuous bight section to form a single continuous upper surface.

The seat cushion body has a pommel or post at the first end, the pommel or post being part of the front end portion. The first height is of the pommel or post.

Pursuant to features of a specific embodiment of the invention, the front end portion including the pommel or post has two first planar side walls extending from the first end to the rear end portion, and the first planar side walls extend in parallel relation to one another. As indicated above, the rear end portion preferably has two second planar side walls extending from the second end towards the front end portion, with these two second planar sidewalls being oriented at an acute angle to one another. Thus the rear end portion has a tapered width dimension that decreases in a direction from the second end to the front end portion.

The rear end portion may have a substantially flat or planar upper surface, the substantially flat or planar upper surface being inclined downwardly in a direction from the second end towards the front end portion.

The pommel or post may have a convexly arcuate upper surface that is continuous with the sloping upper surface of the front end portion of the device.

It is contemplated that the cushion body has a bottom surface that is configured for engagement with a chair seat surface, and that the rear end portion having a substantially flat or planar upper surface.

A kit in accordance with the present invention includes the seat cushion or posture-improvement device described above and additionally includes an auxiliary cushion adapted to engage and support a user's buttocks in the regions of the ischial tuberosities or sit bones while not supporting the user's buttocks in peripheral regions to the outer sides of the ischial tuberosities or sit bones. The additional device is smaller and more easily transportable for use on different chair seats.

A method utilizing the seat cushion or posture-improvement device comprises placing the seat cushion on a horizontal support surface and sitting on the rear end portion so that ischial tuberosities or sit bones of the user engage the rear end portion while peripheral regions of the user's buttocks to outer sides of the ischial tuberosities or sit bones are not in contact with the rear end portion and so that the front end portion is located between the user's thighs and proximate the user's pelvic bone or crotch area.

More generally, the method comprises placing the seat cushion on a horizontal support surface and sitting on the rear end portion with the front end portion located between the user's thighs.

The rear end portion of the seat cushion or sitting device is low and the upper surface thereof has a gentle rise to the second end or back edge. Between the pommel or rounded post at the forward end and the gently raised rear edge, the front end portion of the device exhibits a long gently concave depression or upper surface.

This device will prevent the user's body from degrading owing to poor posture. The improvement in posture results in better support for the internal pelvic organs. The improved posture prevents a tucked pelvis—the typical seated position. Tucking the pelvis puts too much pressure on the Kegel muscle during prolonged sitting which can lead to organ prolapse and urinary incontinence in women.

The above-described device may be included in a two-element kit where the other element is preferably a small rectangular cushion with a width that accommodates or supports the user on the user's ischial tuberosities or sit bones while not supporting the user's buttocks in peripheral regions to the outer sides of the ischial tuberosities or sit bones.

In a less preferred embodiment of the invention, the ancillary cushion element is a wedge that may sit on top of the upper surface of the pommel-exhibiting seat cushion or sitting device to antevert the pelvic region. The wedge, if used, may be introduced gradually, being inserted beneath the buttocks, narrow end forward. The more forward the wedge is disposed, the greater the anteversion of the pelvis. A gradually increasing degree of insertion, over many sessions or days of use, enables the user to become accustomed to the tilt forward.

The present invention provides a method for enhancing seated posture during desk work at a computer or even while seated for eating. Also the present method enables one to "find" the pelvic floor—which is necessary for exercise to strengthen it that induce micro movements and require proproioception and body awareness that is missing in most people. Issues with the pelvic floor includes how to feel it; after squeezing the "pommel" portion of the seating device by using the adductors and all the global moves of the pelvis, hips and core the sitter can "let go" and then by comparison do the micro moves.

Where a planar upper surface of the wedge is placed in contact with the user's buttocks, the wedge pillow will lift the buttocks so that in seated posture the pelvis can move to a slightly anterior position which enables the sitter to be more balanced and allow the upper body to open and feel lighter.

A sitting device or cushion in accordance with the present invention is designed to enable a user to retrain his or body to undo or at least partially reverse damage from poor seated posture. When used as described herein the sitting device or cushion improves standing posture, lifts and lightens the upper body, energizes the breathing, and activates the core abdominals.

The present invention contemplates that 30 minutes of daily use will retrain the body so that the user can sit comfortably with legs uncrossed. The device weighs as little as three ounces but supports the weight of the torso.

In a preferred embodiment, the sitting device or cushion lifts only the SITTING bones, not the entire buttocks. The peripheral regions of the buttocks drape down to the underlying seat or chair surface, but the weight is primarily supported via the cushion or sitting device of the invention. This frees up the circulation in the buttocks areas and results in part in the revitalization of the body during sitting and in the upright postures of standing and walking.

DETAILED DESCRIPTION

Figure 1:
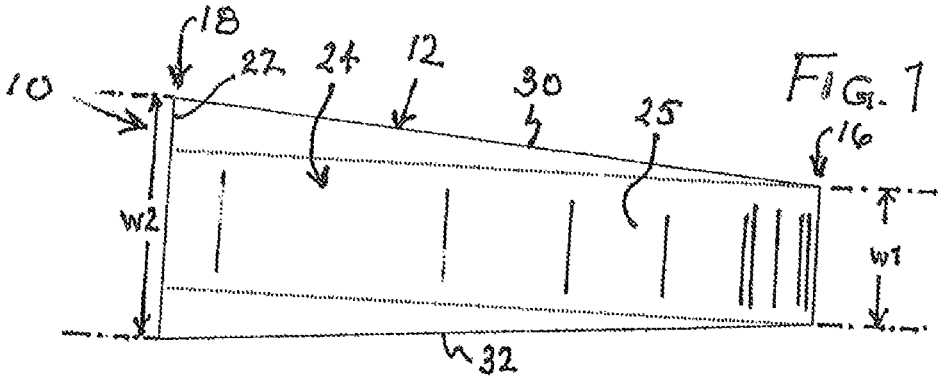
FIG. 1 is a top plan view of a sitting device in accordance with the present invention.
Figure 2:
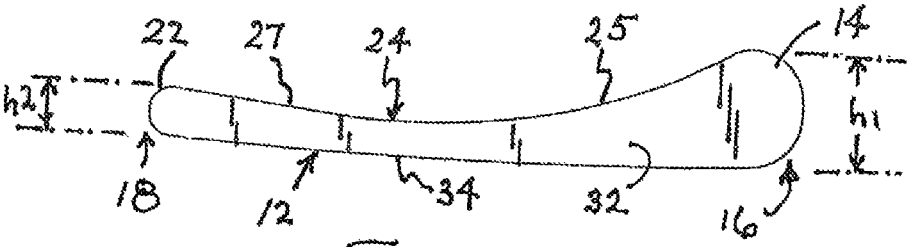
FIG. 2 is a side elevational view of the sitting device of FIG. 1.

As depicted in FIGS. 1 and 2, a device 10 for facilitating better seated posture comprises an elongate body 12 with a front "pommel" type portion 14 that is similar to what is used in a horse riding saddles. Device 10 designed for use while sitting in order to provide long term benefits as to reducing back pain, hip pain, and/or sciatica.

Device 10 comprises a block or body of resiliently compressible material, for instance of polymeric (e.g., PVA) foam material, with a forward end 16 that has a first width w1 and a first height h1 and a back end 18 that has a second width w2 and a second height h2. The first width w1 is substantially less that the second width w2, while the first height h1 is substantially greater than the second height h2. Height h1 is exemplarily between 3 and 5 inches, whereas height h2 need be no larger than one inch. Width w1 is typically between 3 inches and 5 inches, whereas width w2 is between five inches and 12 inches.

In the plan view of FIG. 1, device 10 has a tapered configuration, fanning out from the narrow forward end 16 to the wide back end 18. In the side elevational view of FIG. 2, device 10 exhibits pommel or rounded post 14 at the forward end 16. The rear end 18 is low, but may have a gentle rise towards a back edge 22. Between the pommel or rounded post 14 at the forward end 16 and the rear edge 22, device 10 is characterized by an upper surface 24 that includes a long gently concave depression 25, a sculpted support surface.

In use the pommel or rounded post 14 is a vertical projection that is disposed between the thighs and adjacent the pelvis. Pommel or post 14 extends fully across width w1 and has a uniform transverse cross-section, shown in FIG. 2, taken along all longitudinal planes between forward end 16 and back end 18. Pommel or post 14 is sufficiently high and wide to render leg crossing by the user uncomfortable. The user's buttocks are supported on a rearward platform portion 27. Rear platform portion 27 may exhibit a slight increase in height or thickness in a rearward direction from a middle region of device 10 towards back edge 22. Thus, rear platform portion 27 is engageable with only a portion of a user's buttocks, being devoid of thigh support and havin a width sufficiently small so that undersides of the user's thighs and peripheral regions of the user's buttocks to outer sides of the ischial tuberosities or sit bones are not in contact with seat cushion 10 upon the sitting of the user on rear platform portion 27.

Body 12 has a substantially planar (or slightly convex) bottom surface 34, pommel or post 14 projecting from a side of body 12 opposite bottom surface 34. Body 12 has two planar side walls 30 and 32 extending from forward end 16 to back end 18.

Device 10 will prevent the user's body from degrading owing to poor posture. The improvement in posture results in better support for the internal pelvic organs. The improved posture prevents a tucked pelvis—the typical seated position. Tucking the pelvis puts too much pressure on the Kegel muscle during prolonged sitting which can lead to organ prolapse and urinary incontinence in women.

Figure 4:
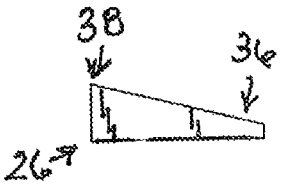
FIG. 4 is a side elevational view of the ancillary sitting device of FIG. 3.
Figure 3:
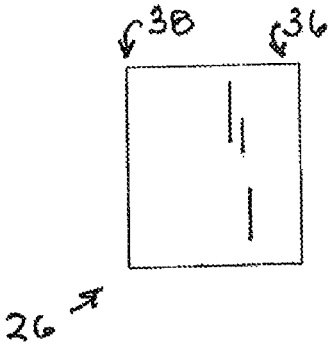
FIG. 3 is a top plan view of an ancillary sitting device utilizable in conjunction with the device of FIGS. 1 and 2.

Device 10 may be included in a two-element kit also including a wedge 26 depicted in FIGS. 3 and 4. Lie device 10, wedge 26 is exemplarily made of a polymeric foam material such as polyethylene (PE) or EVA foam. During combined use of device 10 and wedge 26, wedge 26 is disposed on top of the platform area 24 of device 10, to antevert the user's pelvic region, with a narrow end 36 of the wedge facing pommel 14 and a wide end 38 facing toward rear edge 22. The wedge 26, if used, is preferably introduced gradually, being inserted beneath the buttocks, narrow end 36 forward. The more forward the wedge 26 is disposed, the greater the anteversion of the pelvis. A gradually increasing degree of insertion, over many sessions or days of use, enables the user to become accustomed to the tilt forward.

Figure 5:
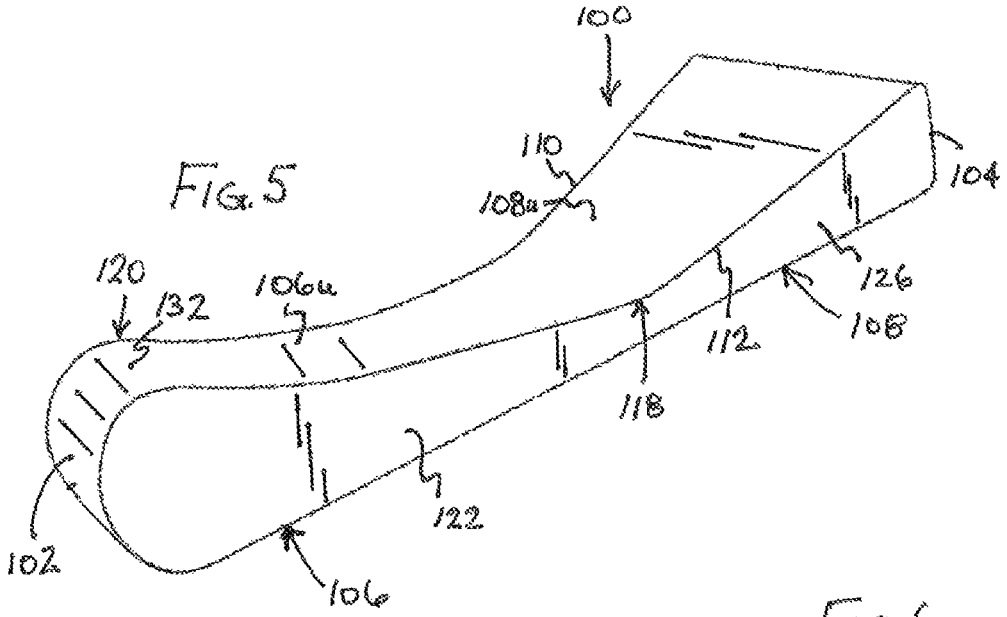
FIG. 5 is a schematic perspective view of another sitting device in accordance with the present invention.
Figure 6:
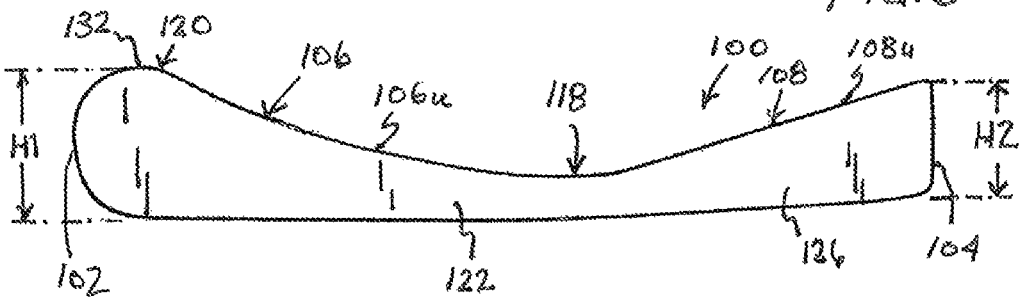
FIG. 6 is a side elevational view of the sitting device of FIG. 5.
Figure 7:
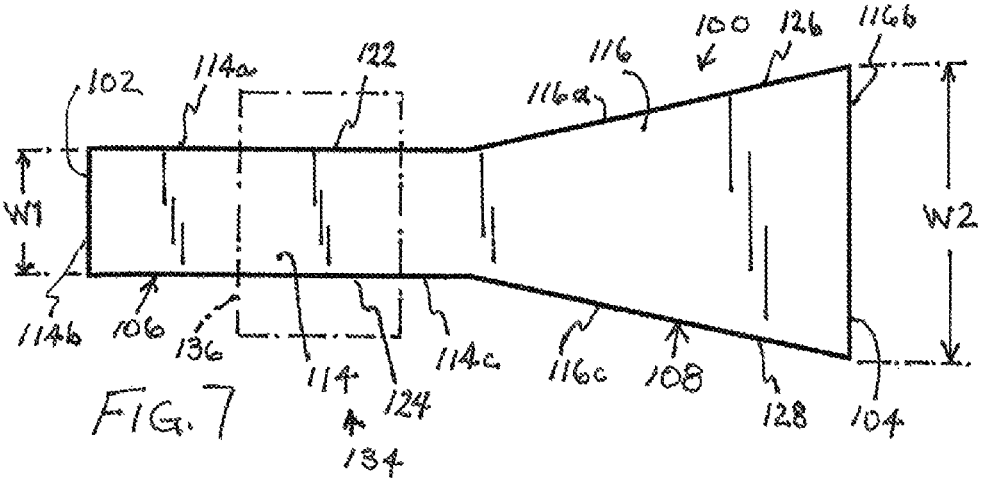
FIG. 7 is a bottom plan view of the sitting device of FIGS. 5 and 6, showing the sitting device as part of a kit including an ancillary rectangular cushion (in phantom lines).

As depicted in FIGS. 5-7, a seat cushion or sitting-posture improvement sitting device 100 comprises a body (not separately designated) of resiliently compressible material such as a polymeric closed cell or open cell foam material. Seat or cushion body 100 has a first end 102 and a second end 104, where the first end has a first width W1 and a first height H1 and the second end has a second width W2 and a second height H2, the first width W1 being substantially smaller than the second width W2. Preferably, but not necessarily, the first height H1, at the front end 102 of the sitting device 100, is greater than the second height H2, at the rear end 104. The second width W2 is sufficiently large so that a wedge-shaped rear end portion 108 of the seat or cushion body 100 including the second end 104 is engageable with a user's buttocks (and particularly with the sit bones thereof), while the first width W1 is sufficiently small so that a wedge-shaped front end portion 106 of the seat or cushion body 100 including the first end 102 is insertable between a user's thighs adjacent the user's pelvis. The first width W1 and the first height H1 are sufficiently large to prevent the user from comfortably crossing the user's legs when the user is sitting on the rear end portion 108 with the front end portion 106 inserted between the user's thighs adjacent the user's pelvis. Front end portion 106 and rear end portion 108 are unitary and contiguous with one another.

Rear end portion 108 of the seat body or cushion 100 has a tapered wedge-shaped configuration, tapering down from rear end 104 towards front end portion 106 that permits the user to adjust the position of the seat cushion or sitting device 100 relative to the user's buttocks so that the ischial tuberosities or sit bones are disposed on or in contact with the rear end portion 108 while peripheral regions or outer sides of the user's buttocks, outwardly lateral of the ischial tuberosities or sit bones, are less compressed inasmuch as they rest on an underlying seat or other horizontal surface rather than on the seat cushion or sitting device 100. Thus, rear end portion 108 is engageable with only a portion of a user's buttocks. Rear end portion 108 is devoid of thigh support and has a width sufficiently small so that undersides of the user's thighs and peripheral regions of the user's buttocks to outer sides of the ischial tuberosities or sit bones are not in contact with seat cushion 100 upon the sitting of the user on rear end portion 108.

More particularly, rear end portion 108 of the seat cushion or sitting-posture improvement device 100 has two opposed upper edges 110 and 112 extending from second end 104 (particularly from an upper edge 111 thereof) towards front end portion 106 and oriented at an acute angle to one another. Concomitantly, rear end portion 108 has a width dimension WW extending between the two opposed upper edges 110 and 112 that decreases in a direction from second end 104 toward front end portion 106. This tapered design enables users who have different distances between their ischial tuberosities or sit bones to position their buttocks on the sitting device 100 near edges 110 and 112 of rear end portion 108, while allowing the outer or lateral portions of the buttocks to rest relatively uncompressed on the underlying support surface. Most of the user's weight is transferred from the ischial tuberosities or sit bones through the cushion or sitting device 100 to an underlying chair seat.

Front end portion 106 of seat cushion or sitting-posture improvement device 100 is contiguous, and continuous or integral, with rear end portion 108 on one side and terminates at first end 102 on an opposite side. Front end portion has a lower or bottom surface 114 that is rectangular on three sides or edges 114*a*, 114*b*, 114*c*. Also, rear end portion 108 is contiguous, and continuous or integral, with front end portion 106 on one side and terminates at second or rear end 104 on an opposite side. Rear end portion 108 has a planar lower or bottom surface 116 that has a truncated triangular shape with three peripheral edges or sides 116*a*, 116*b*, 116*c*. It is contemplated that the lower or bottom surface 114, 116 of seat cushion body or sitting device 100 is configured for engagement with a chair seat surface.

Where front end portion 106 has an upper surface 106*u* and the rear end portion 108 has a planar upper surface 108*u*, upper surface 106*u* preferably slopes downwardly, at an acute angle relative to lower surface 116, from a point proximate the first end 102 towards rear end portion 108, while upper surface 108*u* slopes downwardly from end 104 (or edge 111) towards front end portion 106. Upper surfaces 106*u* and 108*u* join to one another via a smoothly continuous bight section 118 to form a single continuous upper surface (not separately designated).

Seat cushion body or sitting device 100 has a pommel or post 120 at first end 102, the pommel or post being an enlarged part of front end portion 106 at an end thereof opposite rear end portion 108. Height 1 is of the pommel or post 120.

Front end portion 106 including pommel or post 120 has two first planar side walls or lateral surfaces 122, 124 extending from first end 102 toward rear end portion 108. Preferably, planar side walls 122, 124 extend in parallel relation to one another. Rear end portion 108 has two planar side walls 126, 128 extending from rear end 104 towards front end portion 106, with these two planar sidewalls 126, 128 being oriented at an acute angle to one another. Thus rear end portion 108 has a tapered width dimension WW that decreases in a direction from end 104 towards front end portion 106.

Upper surface 108*u* of rear end portion 108 may be substantially flat or planar and inclined downwardly in a direction from end 104 towards the front end portion 106.

Pommel or post 120 may have a convexly arcuate upper surface 132 that is continuous with the sloping upper surface 106*u* of front end portion 106 of seat cushion or sitting device 100.

A kit 134 (FIG. 7) may be provided that includes the seat cushion or posture-improvement sitting device 100 described above and additionally includes one or more auxiliary cushions 136 adapted to engage and support a user's buttocks in the regions of the ischial tuberosities or sit bones while not supporting the user's buttocks in peripheral regions to the outer sides of the ischial tuberosities or sit bones. Cushion or device 136 is smaller than cushion and more easily transportable for use on different chair seats and is preferably in the shape of a wedge identical or similar to wedge 26 (FIGS. 3 and 4) but may take other forms, such as a right rectangular prism. Kit 34 may include several auxiliary cushions of the same or different geometric shapes.

A method utilizing the seat cushion or posture-improvement sitting device 100 comprises placing the seat cushion on a horizontal support surface and sitting on the rear end portion 108 so that ischial tuberosities or sit bones of the user engage the rear end portion while peripheral regions of the user's buttocks to outer sides of the ischial tuberosities or sit bones are not in contact with rear end portion 108 and so that front end portion 106 is located between the user's thighs and proximate the user's pelvic bone or crotch area.

Preferably seat cushion or sitting device 100 is 19" long, with width W1 of pommel 120 at the front being 3 inches, and width W2 at rear end 104 being 7 inches. Wedges 26 and 136 are seven inches square.

A user may sit on one or two wedges 26 or 136, when sitting device 10 or 100 is not available, in order to maintain the postural benefits the user is developing with device 10, 100. In addition, a wedge 26 or 136 may be placed between the user's back and a seat back (not shown) at the low or mid back, for further support. A wedge 26 or 136 may be inserted between the user's head and a high seat back to encourage correct spinal alignment and comfort.

Rear end portion 108 at its widest point (end 104) is only 7 inches wide and supports the user's bony skeleton, lifting the sit bones which are spaced 3-6 inches apart depending on gender—closer in men—and body type—and allows the soft tissue which is muscle & fascia & fat—to relax, which enables reduced tension in the area. Sitting device 10, 100 allows soft tissue to relax but also fits anyone regardless of buttocks size.

By lifting only the sitz bones (the ischial tuberosities or sit bones), seat cushion or sitting device 10, 100 makes the user feel as if there is more "air" space so the lower back can relax more—the normal compression in the back area is relieved and you get the picture. Also seat cushion or sitting device 10, 100 can accommodate any human backside—even a huge or wide one.

It is to be noted that wedges 26, 136 are optional or extras that may be used for comfort in place of SmartSeat™. Wedges 26, 136 are small enough to carry in a purse or briefcase. It is preferable not place a wedge 26, 136 on sitting device 10, 100 as the tilt would be too great and the user would feel as if he or she would fall forward.

Although the invention has been described in terms of particular embodiments and applications, one of ordinary skill in the art, in light of this teaching, can generate additional embodiments and modifications without departing from the spirit of or exceeding the scope of the claimed invention. For instance, instead of the trapezoidal shape in the plan view of FIG. 1, device 10 might have a more organic form, rearward platform portion 27 exemplarily exhibiting a shape of a silhouette of an apple or peach. Pommel portion 14 (120) has an edge on each side where its upper surface (132) intersects with planar side surfaces 30 and 32 (122, 124). Those edges, as well as other edges of device 10 (100) may be rounded or beveled. In some cases, depending on the sensitivity and proclivities of the user and the dimensions and particular geometry of the device 10, the edges may provide a noticeable, even irritating, sensory input to the thighs, which may result in a conditioning effect whereby the user learns not to cross her or her legs even when not using the device 10 (100).

Accordingly, it is to be understood that the drawings and descriptions herein are proffered by way of example to facilitate comprehension of the invention and should not be construed to limit the scope thereof.

What is claimed is:

1. A method comprising:

providing a seat cushion comprising a body of resiliently compressible material having an upper side and a lower side, said body having a wedge-shaped front end portion and a wedge-shaped rear end portion, said front end portion and said rear end portion being continuous and unitary with one another, said front end portion having parallel opposed planar sidewalls and a uniform first width between said parallel opposed planar sidewalls and a first height varying from a maximum proximate a free end of said front end portion opposite said rear end portion to a minimum proximate an end of said front end portion joined to and continuous with said rear end portion, said rear end portion having mutually angled opposed planar sidewalls and a second width between said mutually angled opposed planar sidewalls and a second height, said second width varying from a minimum at an end of said rear end portion joined to and contiguous with said front end portion to a maximum at an end of said rear end portion opposite said front end portion, said first width being substantially smaller than the maximum of said second width, said rear end portion having a planar lower surface and a planar upper surface both substantially coextensive with said rear end portion, said planar upper surface being inclined at an angle to said planar lower surface, said rear end portion being engageable with only a portion of a user's buttocks, said rear end portion being sufficiently small so that undersides of the user's thighs and peripheral regions of the user's buttocks to outer sides of the ischial tuberosities or sit bones are not in contact with said seat cushion upon the sitting of the user on said rear end portion, said first width being sufficiently small so that said front end portion is insertable between a user's thighs adjacent the user's pelvis;

placing the seat cushion on a horizontal support surface; and sitting on said rear end portion with said front end portion located between the user's thighs so that said rear end portion is in supportive contact with ischial tuberosities or sit bones of the user and so that peripheral regions of the user's buttocks to outer sides of the ischial tuberosities or sit bones are out of contact with said rear end portion.

2. The method defined in claim 1 wherein said rear end portion being defined on an upper side by two straight or linear opposed outermost edges extending from said front end portion to said rear end of said rear end portion, said two straight or linear opposed outermost edges being oriented at an acute angle to one another, said second width subtending between said straight or linear opposed outermost edges increasing in a direction from said front end portion to said rear end of said rear end portion.

3. The method defined in claim 2 wherein said body has a pommel or post at an end of said front end portion opposite said rear end portion, said pommel or post being part of said front end portion.

4. The method defined in claim 3 wherein said parallel opposed planar side walls extend from said rear end portion and define opposed sides of said pommel or post, said mutually angled opposed planar side walls extending from said front end portion and being bounded on an upper side by respective ones of said two straight or linear opposed outermost edges, each of said parallel opposed planar side walls being joined to or continuous with a respective one of said mutually angled opposed planar side walls.

5. The method defined in claim 4 wherein said pommel or post has a convexly arcuate upper surface oriented perpendicularly to said parallel opposed planar side walls and is defined in part by a pair of parallel edges each continuous at a rear side with a respective one of said two straight or linear opposed outermost edges.

6. The method defined in claim 1 wherein said front end portion has a lower surface coextensive with said front end portion and rectangular on three sides, said rear end portion having a lower surface coextensive with said rear end portion and in the form of a truncated triangle.

7. The method defined in claim 6 wherein said front end portion has a first respective upper surface sloping downwardly towards said rear end portion, said planar upper surface sloping downwardly towards said front end portion.

8. The method defined in claim 7 wherein said body has a pommel or post at an end of said front end portion opposite said second end portion, said pommel or post being part of said front end portion, said pommel or post having a convexly arcuate upper surface that is continuous with said planar upper surface and is defined in part by a pair of parallel edges each continuous at a rear side with a respective one of two opposed edges of said planar upper surface.

9. A method comprising:

providing seat cushion comprising a body of resiliently compressible material, said body having a first end portion and a second end portion unitary and contiguous with one another, said first end portion being planar on a lower side and having on said lower side an outermost boundary formed on three sides by three edges of a rectangle and on a fourth side by said second end portion, said second end portion being planar on a lower side with an outermost boundary formed on three sides by three contiguous edges of a truncated triangle and on a fourth side by said first end portion, said truncated triangle being wider than said rectangle, said first end portion having opposed planar side or lateral surfaces extending from said lower side of said first end portion to an upper side thereof and oriented perpendicularly to said lower side of said first end portion, said opposed planar side or lateral surfaces each having an enlarged free end opposite said second end portion, said opposed planar side or lateral surfaces of said first end portion having a height tapering down from said enlarged head toward said first end portion, said second end portion being engageable with only a portion of a user's buttocks, said second end portion being sufficiently small so that undersides of a user's thighs and peripheral regions of the user's buttocks to outer sides of the ischial tuberosities or sit bones are not in contact with said seat cushion upon the sitting of the user on said second end portion, said first end portion being insertable between a user's thighs adjacent the user's pelvis; and placing the lower side of the seat cushion on a horizontal support surface; and sitting on said second end portion so that ischial tuberosities or sit bones of the user engage said second end portion while peripheral regions of the user's buttocks to outer sides of the ischial tuberosities or sit bones are not in contact with said second end portion and so that said first end portion is located between the user's thighs and proximate the user's pelvic bone or crotch area.

10. A method of sitting, comprising:

providing a seat cushion with a rear end portion at one end and a pommel portion at an opposite end, said rear end portion having a planar lower surface and a planar upper surface both substantially coextensive with said rear end portion, said rear end portion having opposed planar lateral side surfaces each extending from one end of said rear end portion to an opposite end thereof, said upper surface being inclined at a first angle to said lower surface and said planar lateral surfaces being oriented at a second angle to one another, at least a segment of said rear end portion being sufficiently wide to engage ischial tuberosities or sit bones of the user and sufficiently narrow so that undersides of the user's thighs and peripheral regions of the user's buttocks to outer sides of the ischial tuberosities or sit bones are not in contact with said seat cushion upon the sitting of the user on said rear end portion, said rear end portion of said seat cushion being devoid of thigh support;

placing the seat cushion on a horizontal support surface;

sitting on said rear end portion so that said rear end portion is in supportive contact with ischial tuberosities or sit bones of a user and so that peripheral regions of the user's buttocks to outer sides of the ischial tuberosities or sit bones are not in contact with said rear end portion; and positioning said pommel portion between the user's thighs and proximate the user's pelvic bone or crotch area.

* * * * *